US010677153B1

(12) United States Patent
Gautam et al.

(10) Patent No.: US 10,677,153 B1
(45) Date of Patent: Jun. 9, 2020

(54) TURBOCHARGER COMPRESSOR WITH ADJUSTABLE-TRIM MECHANISM AND NOISE-ATTENUATOR

(71) Applicant: Garrett Transportation I Inc., Torrance, CA (US)

(72) Inventors: Bhushan Singh Gautam, Bangalore (IN); Hani Mohtar, Chaumousey (FR); Chaitanya Bhat, Bangalore (IN); Stephane Pees, Ceintrey (FR); Sowmya Bolakonda, Bangalore (IN)

(73) Assignee: Garrett Transportation I Inc., Torrance, CA (US)

( * ) Notice: Subject to any disclaimer, the term of this patent is extended or adjusted under 35 U.S.C. 154(b) by 0 days.

(21) Appl. No.: 16/214,191

(22) Filed: Dec. 10, 2018

(51) Int. Cl.
*F02B 37/24* (2006.01)
*F01D 17/16* (2006.01)
*F01D 17/14* (2006.01)

(52) U.S. Cl.
CPC ..... *F02B 37/24* (2013.01); *F01D 17/141* (2013.01); *F01D 17/167* (2013.01); *F05D 2220/40* (2013.01)

(58) Field of Classification Search
CPC ..... F02B 37/24; F01D 17/167; F01D 17/141; F05D 2220/40
USPC ..... 417/405–407
See application file for complete search history.

(56) References Cited

U.S. PATENT DOCUMENTS 3,077,731 A * 2/1963 Addie ..... F02B 33/00 60/599
4,107,927 A * 8/1978 Gordon, Jr. ..... F01D 25/125 60/605.1
5,333,576 A 8/1994 Verkleeren
6,899,531 B2 * 5/2005 Hummel ..... F01D 25/16 415/119
6,918,740 B2 7/2005 Liu
6,983,820 B2 1/2006 Boast et al.
7,108,488 B2 * 9/2006 Larue ..... F16C 17/024 384/103
7,624,575 B2 * 12/2009 Noelle ..... F01D 25/24 60/605.1

(Continued)

FOREIGN PATENT DOCUMENTS

CN 105909562 A 8/2016

OTHER PUBLICATIONS

"Design of Quarter Wave Tube for Engine Intake Noise Attenuation by Finite Element Analysis", Mehmet Caliskan et al., presented at inter-noise 2009 Conference, Aug. 23-26, 2009.

(Continued)

*Primary Examiner* — Hoang M Nguyen
(74) *Attorney, Agent, or Firm* — John C. James

(57) ABSTRACT

A compressor for a turbocharger includes an inlet-adjustment mechanism in an air inlet for the compressor, operable to move between an open position and a closed position. The inlet-adjustment mechanism includes a plurality of blades disposed about the air inlet, the blades being movable radially inwardly from an annular space of the air inlet wall, into the air inlet, so as to form an orifice of reduced diameter relative to a nominal diameter of the inlet. A noise-attenuator is disposed in the annular space, downstream of the inlet-adjustment mechanism, for attenuating aerodynamic noise induced by the inlet-adjustment mechanism when it is closed.

13 Claims, 8 Drawing Sheets

(56) References Cited

U.S. PATENT DOCUMENTS

| | | | | |
|---|---|---|---|---|
| 2002/0071765 | A1* | 6/2002 | Sahay | F02B 37/16 415/206 |
| 2011/0255952 | A1* | 10/2011 | Williams | F04D 29/441 415/1 |
| 2017/0298953 | A1 | 10/2017 | Lombard et al. | |

OTHER PUBLICATIONS

Extended European Search Report in EP Appl. No. 19207598.4-1007, dated Apr. 15, 2020.

* cited by examiner

TURBOCHARGER COMPRESSOR WITH ADJUSTABLE-TRIM MECHANISM AND NOISE-ATTENUATOR

BACKGROUND OF THE INVENTION

The present disclosure relates to compressors, such as used in turbochargers, and more particularly relates to compressors in which the effective inlet area or diameter can be adjusted for different operating conditions.

An exhaust gas-driven turbocharger is a device used in conjunction with an internal combustion engine for increasing the power output of the engine by compressing the air that is delivered to the air intake of the engine to be mixed with fuel and burned in the engine. A turbocharger comprises a compressor wheel mounted on one end of a shaft in a compressor housing and a turbine wheel mounted on the other end of the shaft in a turbine housing. Typically the turbine housing is formed separately from the compressor housing, and there is yet another center housing connected between the turbine and compressor housings for containing bearings for the shaft. The turbine housing defines a generally annular chamber that surrounds the turbine wheel and that receives exhaust gas from an engine. The turbine assembly includes a nozzle that leads from the chamber into the turbine wheel. The exhaust gas flows from the chamber through the nozzle to the turbine wheel and the turbine wheel is driven by the exhaust gas. The turbine thus extracts power from the exhaust gas and drives the compressor. The compressor receives ambient air through an inlet of the compressor housing and the air is compressed by the compressor wheel and is then discharged from the housing to the engine air intake.

Turbochargers typically employ a compressor wheel of the centrifugal (also known as "radial") type because centrifugal compressors can achieve relatively high pressure ratios in a compact arrangement. Intake air for the compressor is received in a generally axial direction at an inducer portion of the centrifugal compressor wheel and is discharged in a generally radial direction at an exducer portion of the wheel. The compressed air from the wheel is delivered to a volute, and from the volute the air is supplied to the intake of an internal combustion engine.

The operating range of the compressor is an important aspect of the overall performance of the turbocharger. The operating range is generally delimited by a surge line and a choke line on an operating map for the compressor. The compressor map is typically presented as pressure ratio (discharge pressure Pout divided by inlet pressure Pin) on the vertical axis, versus corrected mass flow rate on the horizontal axis. The choke line on the compressor map is located at high flow rates and represents the locus of maximum mass-flow-rate points over a range of pressure ratios; that is, for a given point on the choke line, it is not possible to increase the flow rate while maintaining the same pressure ratio because a choked-flow condition occurs in the compressor.

The surge line is located at low flow rates and represents the locus of minimum mass-flow-rate points without surge, over a range of pressure ratios; that is, for a given point on the surge line, reducing the flow rate without changing the pressure ratio, or increasing the pressure ratio without changing the flow rate, would lead to surge occurring. Surge is a flow instability that typically occurs when the compressor blade incidence angles become so large that substantial flow separation arises on the compressor blades. Pressure fluctuation and flow reversal can happen during surge.

In a turbocharger for an internal combustion engine, compressor surge may occur when the engine is operating at high load or torque and low engine speed, or when the engine is operating at a low speed and there is a high level of exhaust gas recirculation (EGR). Surge can also arise when an engine is suddenly decelerated from a high-speed condition. Expanding the surge-free operation range of a compressor to lower flow rates is a goal often sought in compressor design.

Applicant is the owner of several patent applications describing various inlet-adjustment mechanisms for delaying the onset of surge to lower flow rates at a given compressor pressure ratio (i.e., shifting the surge line to the left on the compressor map), including but not limited to: application Ser. No. 14/642,825 filed on Mar. 10, 2015; Ser. No. 14/551,218 filed on Nov. 24, 2014; Ser. No. 14/615,428 filed on Feb. 6, 2016; Ser. No. 15/446,054 filed on Mar. 1, 2017; Ser. No. 15/446,090 filed on Mar. 1, 2017; Ser. No. 15/456,403 filed on Mar. 10, 2017; Ser. No. 15/836,781 filed on Dec. 8, 2017; Ser. No. 15/806,267 filed on Nov. 7, 2017; Ser. No. 15/822,093 filed on Nov. 24, 2017; Ser. No. 15/907,420 filed on Feb. 28, 2018; Ser. No. 15/904,493 filed on Feb. 26, 2018; and Ser. No. 15/909,899 filed on Mar. 1, 2018; the entire disclosures of all of said applications being hereby incorporated herein by reference. Inlet-adjustment mechanisms in accordance with said applications generally include a plurality of blades or vanes that collectively circumscribe an orifice whose effective diameter is adjustable by movement of the blades or vanes radially inwardly or outwardly. By adjusting the effective compressor inlet diameter to a reduced value at operating conditions where surge may be imminent, the surge line on the compressor map is shifted toward lower flow rates, thereby preventing surge from occurring at said operating conditions.

BRIEF SUMMARY OF THE DISCLOSURE

The present application relates to turbochargers whose compressor includes an inlet-adjustment mechanism of the type noted above. Applicant has discovered that when the inlet-adjustment mechanism is closed to effectively reduce the diameter of the compressor inlet, the mechanism can generate aerodynamically induced noise at certain frequencies. It is an aim of the present application to address this issue and mitigate such noise.

In one embodiment described herein, a turbocharger comprises a turbine including a turbine housing, and a compressor assembly comprising a compressor housing and a compressor wheel mounted in the compressor housing and connected to a rotatable shaft for rotation therewith. The compressor wheel has blades and defines an inducer portion, the compressor housing having an air inlet wall defining an air inlet for leading air generally axially into the compressor wheel, the air inlet wall defining an annular space therein upstream of the compressor wheel, a radially innermost extremity of the annular space being open to the air inlet.

An inlet-adjustment mechanism is disposed in the air inlet and is adjustable between an open position and a closed position. The inlet-adjustment mechanism comprises a plurality of blades disposed about the air inlet and collectively circumscribing an orifice, the blades being movable radially inwardly into the air inlet when the blades are in the closed position so as to cause the orifice to have a reduced diameter relative to a nominal diameter of the inlet.

The turbocharger further comprises a noise-attenuator disposed in the annular space downstream of the inlet-adjustment mechanism, the noise-attenuator being structured and arranged to define axially consecutive first and second annular cavities each of which is open to the air inlet. The first annular cavity has a radial height h1 and the second annular cavity has a radial height h2. In accordance with this embodiment of the invention, h1 and h2 are not equal.

In one embodiment, the first annular cavity is upstream of the second annular cavity, and h1 is greater than h2. In another embodiment, the two cavity heights are equal.

In one embodiment described herein, the noise-attenuator comprises a ring-shaped first plate and a ring-shaped second plate axially abutting the first plate. The first plate defines a flange at a radially outer periphery thereof, the flange projecting axially upstream from an upstream face of the first plate.

In accordance with one embodiment, the inlet-adjustment mechanism includes a rotatable unison ring for actuating movement of the blades, and the unison ring abuts the flange of the first plate, the flange forming a bearing surface for the unison ring when the unison ring is rotated.

The blades of the inlet-adjustment mechanism can be mounted to the first plate by pivot pins, the blades engaging the unison ring such that rotation of the unison ring in one direction or an opposite direction causes the blades to pivot radially inwardly or radially outwardly for adjusting a size of the orifice.

In accordance with a further embodiment of the invention, the noise-attenuator cooperates with the annular space in the air inlet wall to define an annular cavity, and the noise-attenuator comprises a plurality of elongate fingers that bridge across from an upstream side to a downstream side of the annular cavity, adjacent a radially inner end thereof. The fingers are non-uniformly circumferentially spaced about an entire circumference of the air inlet.

In an embodiment, the noise-attenuator comprises a ring-shaped plate, the fingers projecting axially downstream from a downstream face of the plate adjacent a radially inner periphery thereof.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present inventions now will be described more fully hereinafter with reference to the accompanying drawings, in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
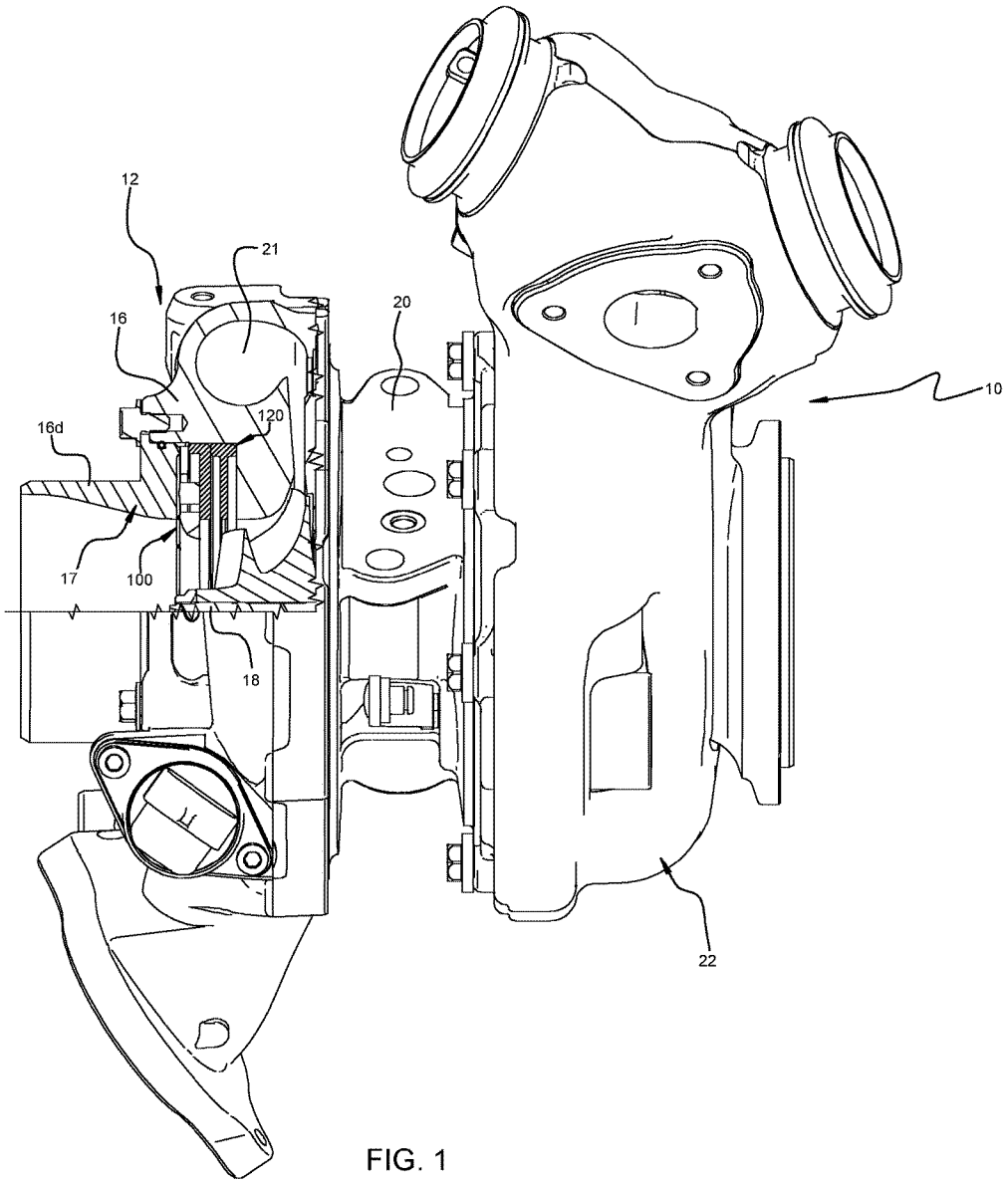
FIG. 1 is a side view of a turbocharger in accordance with one embodiment of the invention, partly sectioned to show internal features of the compressor.
Figure 2:
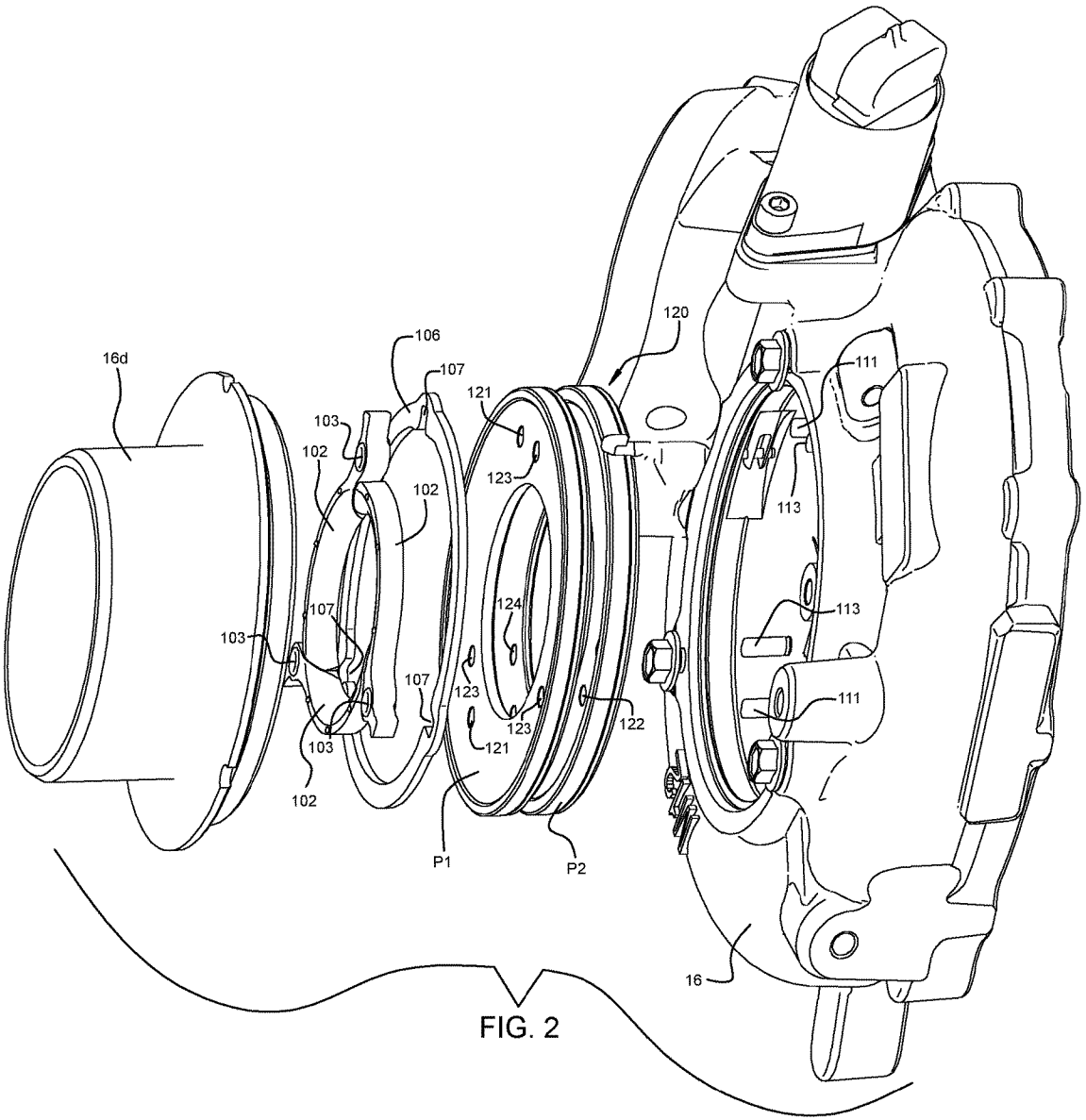
FIG. 2 is an exploded view of a compressor assembly for the turbocharger of FIG. 1.
Figure 3:
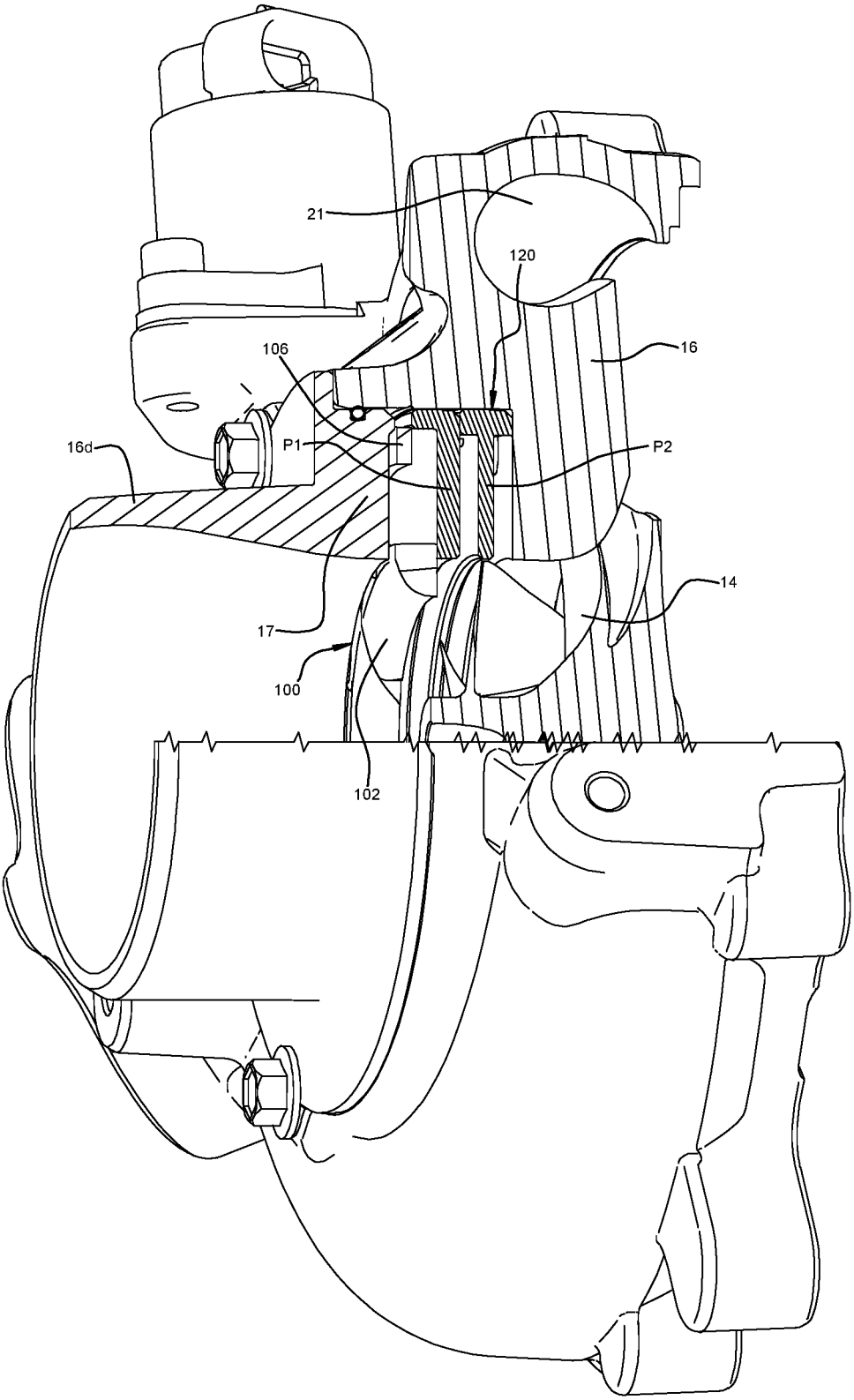
FIG. 3 is an isometric view of the compressor assembly, partly sectioned to show internal features of the compressor.

A turbocharger 10 in accordance with one embodiment of the invention is illustrated in side view in FIG. 1, and an axial cross-sectional view of the turbocharger is shown in FIG. 2. The turbocharger includes a compressor 12 and a turbine 22. The compressor comprises a compressor wheel or impeller 14 mounted in a compressor housing 16 on one end of a rotatable shaft 18. The compressor housing includes an air inlet wall 17 that defines an air inlet for leading air generally axially into the compressor wheel 14. The shaft is supported in bearings mounted in a center housing 20 of the turbocharger. The shaft is rotated by a turbine wheel (not visible in FIG. 1) of the turbine 22. The turbine wheel is mounted on the other end of the shaft 18 from the compressor wheel, thereby rotatably driving the compressor wheel, which compresses air drawn in through the compressor inlet and discharges the compressed air generally radially outwardly from the compressor wheel into a volute 21 for receiving the compressed air. From the volute 21, the air is routed to the intake of an internal combustion engine (not shown) for boosting the performance of the engine.

The turbine wheel is disposed within a turbine housing 24 that defines an annular chamber for receiving exhaust gases from an internal combustion engine (not shown). The turbine housing also defines a nozzle for directing exhaust gases from the chamber generally radially inwardly to the turbine wheel. The exhaust gases are expanded as they pass through the turbine wheel, and rotatably drive the turbine wheel, which in turn rotatably drives the compressor wheel 14 as already noted.

Figure 1A:
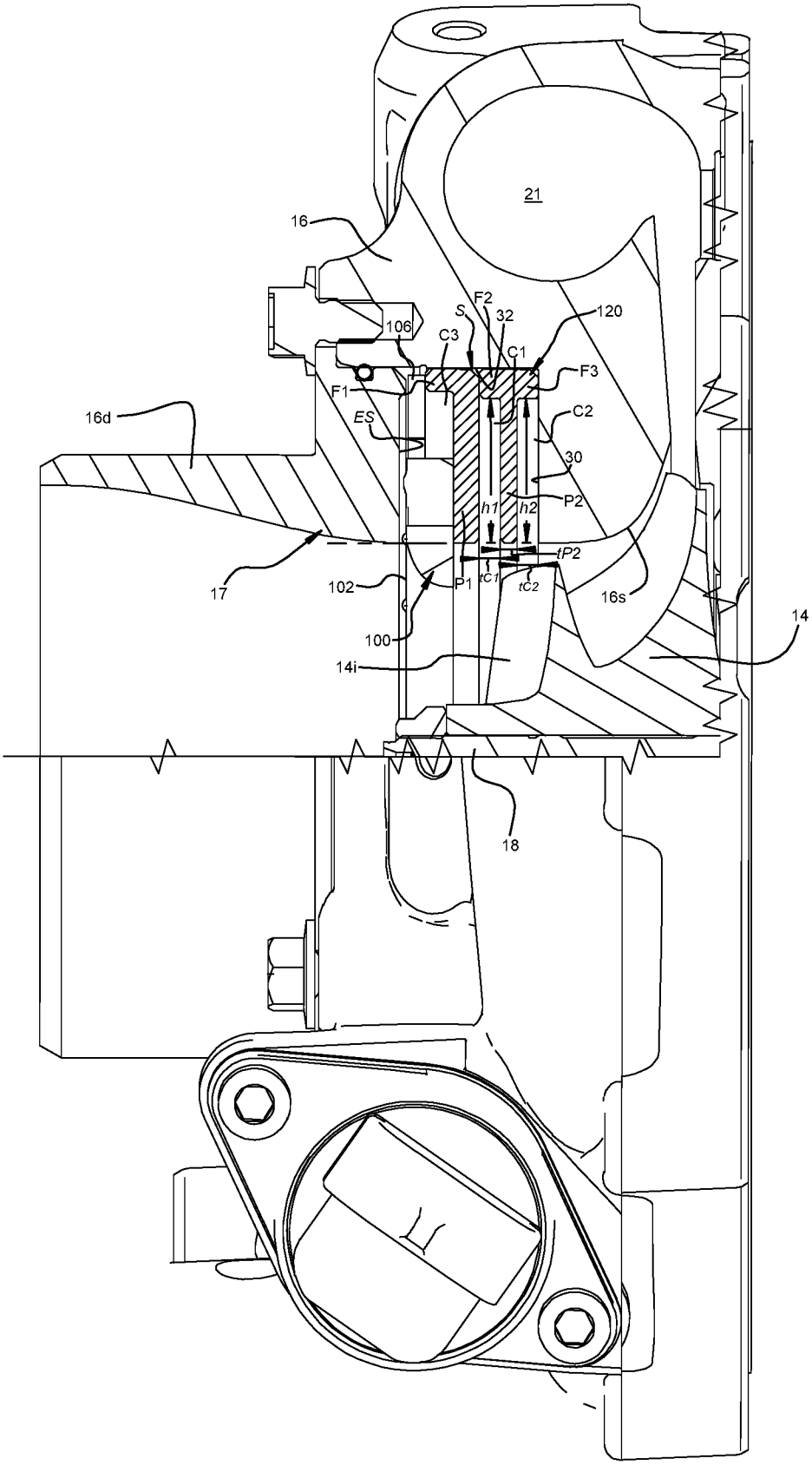
FIG. 1A is a magnified portion of FIG. 1, showing the compressor of the turbocharger.

With reference now to FIG. 1A, in the illustrated embodiment, the air inlet wall 17 is formed in part by the compressor housing 16 and in part by a separate inlet duct member 16*d* that is received into a cylindrical receptacle defined by the compressor housing. The portion of the air inlet wall 17 proximate the compressor wheel 14 defines a generally cylindrical inner surface that has a diameter generally matched to the diameter of an inducer portion 14*i* of the compressor wheel.

The compressor housing 16 defines a shroud surface 16*s* that is closely adjacent to the radially outer tips of the compressor blades. The shroud surface defines a curved contour that is generally parallel to the contour of the compressor wheel.

In accordance with a first embodiment of the invention, the compressor of the turbocharger includes an inlet-adjustment mechanism 100 disposed in an annular space S within the air inlet wall 17. The annular space S is defined between a downstream-facing end surface ES of the inlet duct member 16*d*, an upstream-facing surface 30 of the compressor housing 16, and a cylindrical radially inwardly facing surface 32 of the compressor housing. The inlet-adjustment mechanism comprises a ring-shaped assembly and is operable for adjusting an effective diameter of the air inlet into the compressor wheel. As such, the inlet-adjustment mechanism is movable between an open position and a closed position, and in some embodiments can be closed still further to a super-closed position, and can be configured to be adjusted to various points intermediate between said positions.

With reference now to FIG. 2, the inlet-adjustment mechanism comprises a plurality of blades 102 arranged about the central axis of the air inlet and each pivotable about a pivot pin located at or near one end of the blade. The mechanism further comprises a unison ring 106 that is rotatable about the central axis and is engaged with each of the blades 102 such that rotation of the unison ring in one direction causes the blades to pivot radially inwardly and rotation in the opposite direction causes the blades to pivot radially outwardly. Alternatively, the inlet-adjustment mechanism can comprise other types of blade or vane arrangements that actuate the blades or vanes to move inwardly or outwardly in a different fashion, e.g., translating radially, or moving with a combined radial and circumferential motion (i.e., helical motion).

The range of pivotal movement of the blades 102 is sufficient that the blades can be pivoted radially outwardly by rotation of the unison ring in one direction to an open position, in which the blades are entirely radially outward of the inner surface of the air inlet wall 17. As such, in the open position of the blades, the inlet-adjustment mechanism does not alter the nominal inlet diameter as defined by the inlet surface.

The blades can also be pivoted radially inwardly by rotation of the unison ring in the opposite direction to a closed position. In the closed position, the circular-arc edges along the radially inner sides of the blades 102 collectively form an orifice that is substantially a circle having a diameter that is less than that of the inlet inner surface. This has the consequence that the effective diameter of the inlet is reduced relative to the nominal inlet diameter. In this manner, the inlet-adjustment mechanism is able to regulate the effective diameter of the air inlet approaching the compressor wheel.

At low flow rates (e.g., low engine speeds), the inlet-adjustment mechanism 100 can be placed in the closed position. This can have the effect of reducing the effective inlet diameter and thus of increasing the flow velocity into the compressor wheel. The result will be a reduction in compressor blade incidence angles, effectively stabilizing the flow (i.e., making blade stall and compressor surge less likely). In other words, the surge line of the compressor will be moved to lower flow rates (to the left on a map of compressor pressure ratio versus flow rate).

At intermediate and high flow rates, the inlet-adjustment mechanism 100 can be partially opened or fully opened. This can have the effect of increasing the effective inlet diameter so that the compressor regains its high-flow performance and choke flow essentially as if the inlet-adjustment mechanism were not present and as if the compressor had a conventional inlet matched to the wheel diameter at the inducer portion of the wheel.

Figure 4A:
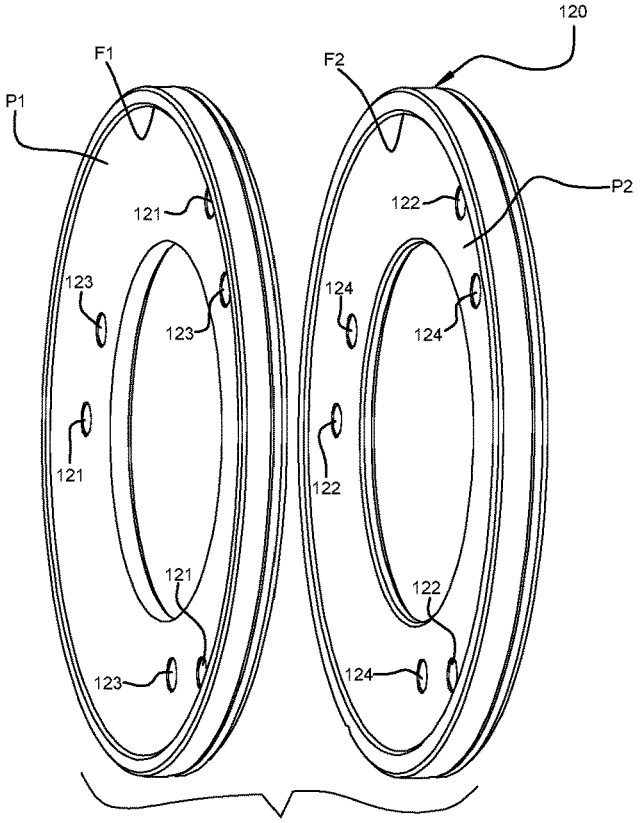
FIG. 4A is an exploded view of a noise-attenuator for the turbocharger of FIG. 1.
Figure 4B:
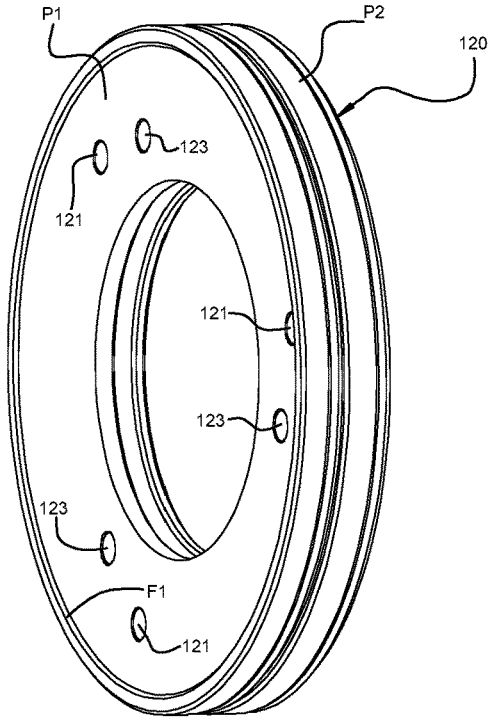
FIG. 4B is an isometric view of the noise-attenuator.

As previously noted, Applicant has discovered that when the inlet-adjustment mechanism is in the closed position, the mechanism tends to generate aerodynamically induced noise at certain frequencies. It is desired to attenuate this noise as much as practicable without compromising the surge-delaying benefits of the mechanism. In accordance with the invention, in one embodiment noise attenuation is accomplished by providing a noise-attenuator 120 located just downstream of the inlet-adjustment mechanism 100, as best seen in FIGS. 1A, 4A, and 4B. The noise-attenuator 120 is disposed within the annular space S of the air inlet wall 17. As shows in FIG. 1A, the inlet-adjustment mechanism 100 is also disposed within the annular space S, immediately adjacent to the end surface ES of the inlet duct member 16*d*. The noise-attenuator 120 is disposed downstream of the inlet-adjustment mechanism, and comprises a ring-shaped first plate P1 and a ring-shaped second plate P2 that are consecutively axially disposed, such that the first plate P1 confronts the inlet-adjustment mechanism 100, and the second plate P2 is immediately downstream of the first plate. The noise-attenuator is structured and arranged to define at least two axially consecutive annular cavities each of which is open to the air inlet. In the illustrated embodiment, the noise-attenuator defines two such axially consecutive annular cavities C1 and C2. A further annular cavity C3 is defined by the abutment of a first flange F1 from a radially outer periphery of the first plate P1 with the unison ring 106 of the inlet-adjustment mechanism, but this cavity C3 is unrelated to noise attenuation, being instead the space in which the inlet-adjustment mechanism 100 resides. The first flange extends in the upstream direction from the first plate to abut the unison ring, thereby spacing the unison ring axially away from the upstream face of the first plate P1. The blades 102 of the inlet-adjustment mechanism are pivotally mounted (as further described below) to the first plate P1 and at least partially reside within the third annular cavity C3.

The first annular cavity C1 is defined by the abutment of a second flange F2 from the second plate P2 with a downstream side of the first plate P1, the second flange F2 projecting in the upstream direction from a radially outer periphery of the second plate. The second annular cavity has a radial height h1. It will be appreciated that the first cavity could be created by a second flange projecting downstream from the first plate P1 and abutting the second plate P2 (which then would not have a flange at its upstream side). The invention is not limited to any particular structures or arrangements for creating the cavities.

A second annular cavity C2 is defined by the abutment of a third flange F3, which projects in the downstream direction from a radially outer periphery of the second plate P2, with the downstream wall 30 of the annular space S defined in the air inlet wall 17. The second annular cavity has a radial height h2. The values of h1 and h2 can be equal or can differ from each other.

The first annular cavity C1 has an axial width of tC1, and the second annular cavity C2 has an axial width of tC2. The second plate P2 has an axial thickness of tP2. Advantageously, the values of tC1 and tC2 are not equal to the plate thickness tP2. For example, as illustrated in FIG. 1A, the cavity widths tC1 and tC2 can be equal to each other and can be greater than the second plate thickness tP2.

As previously noted, the blades 102 of the inlet-adjustment mechanism are pivotally mounted to the first plate P1. This is accomplished by a plurality of pins 113 (FIG. 2), there being one such pin for each blade, that are fixedly mounted in holes (not shown) in the downstream wall 30 (FIG. 1A) of the compressor housing 16, which wall 30 bounds the downstream extremity of the annular space S. The pins 113 pass through corresponding holes 124 in the second plate P2 and through corresponding holes 123 in the first plate P1, and are received in bearing holes 103 in each of the blades 102, as best seen in FIG. 2. The blades 102 thus are pivotable about the pins 113. Ends of the blades are received into slots 107 in the inner periphery of the unison ring 106, and hence rotation of the unison ring about the turbocharger axis causes the blades to pivot as noted. Rotation of the unison ring is guided by a plurality of guide pins 111 that are fixedly mounted in holes (not shown) in the downstream wall 30. The guide pins pass through corresponding holes 122 in the second plate P2 and through corresponding holes 121 in the first plate P1 and engage with the inner periphery of the unison ring 106 to guide its rotational motion and keep it substantially concentric with the turbocharger axis.

The two annular cavities C1 and C2 act as quarter-wave resonators for the main fluid flow passing through the air inlet toward the compressor wheel. As those skilled in the art will recognize, a quarter-wave resonator can be tuned to a certain fundamental frequency, so that it attenuates that frequency and harmonics of that frequency, based on the length (which in this case is the radial height h1 or h2) of the cavity. Thus, the two cavities C1 and C2 can be tuned to the same frequency by making their radial heights equal, or can be tuned to different frequencies by making their radial heights different from each other. Both possibilities are included within the scope of the present invention. Additionally, the plate P2 between the two cavities serves as a partition wall that helps reduce the energy of vortices generated from the blades of the inlet-adjustment mechanism 100, and hence helps reduce the noise associated with such vortical flow. While the illustrated embodiment has two such annular cavities acting as quarter-wave resonators, the invention is not limited in that respect, and more than two such cavities can be employed if advantageous in a particular case.

Figure 5:
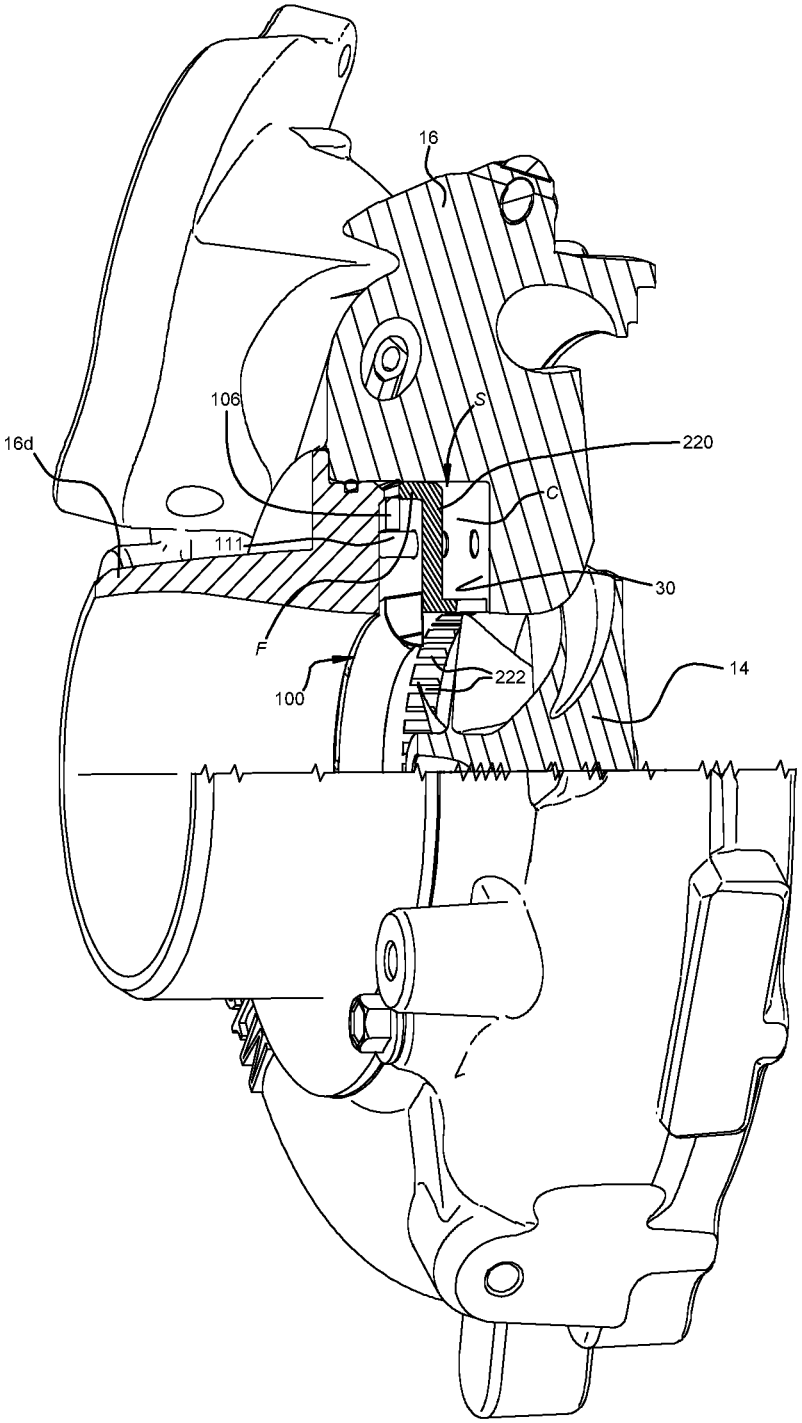
FIG. 5 is an isometric view of a compressor assembly in accordance with another embodiment of the invention, partly sectioned to show internal details of the compressor.
Figure 6:
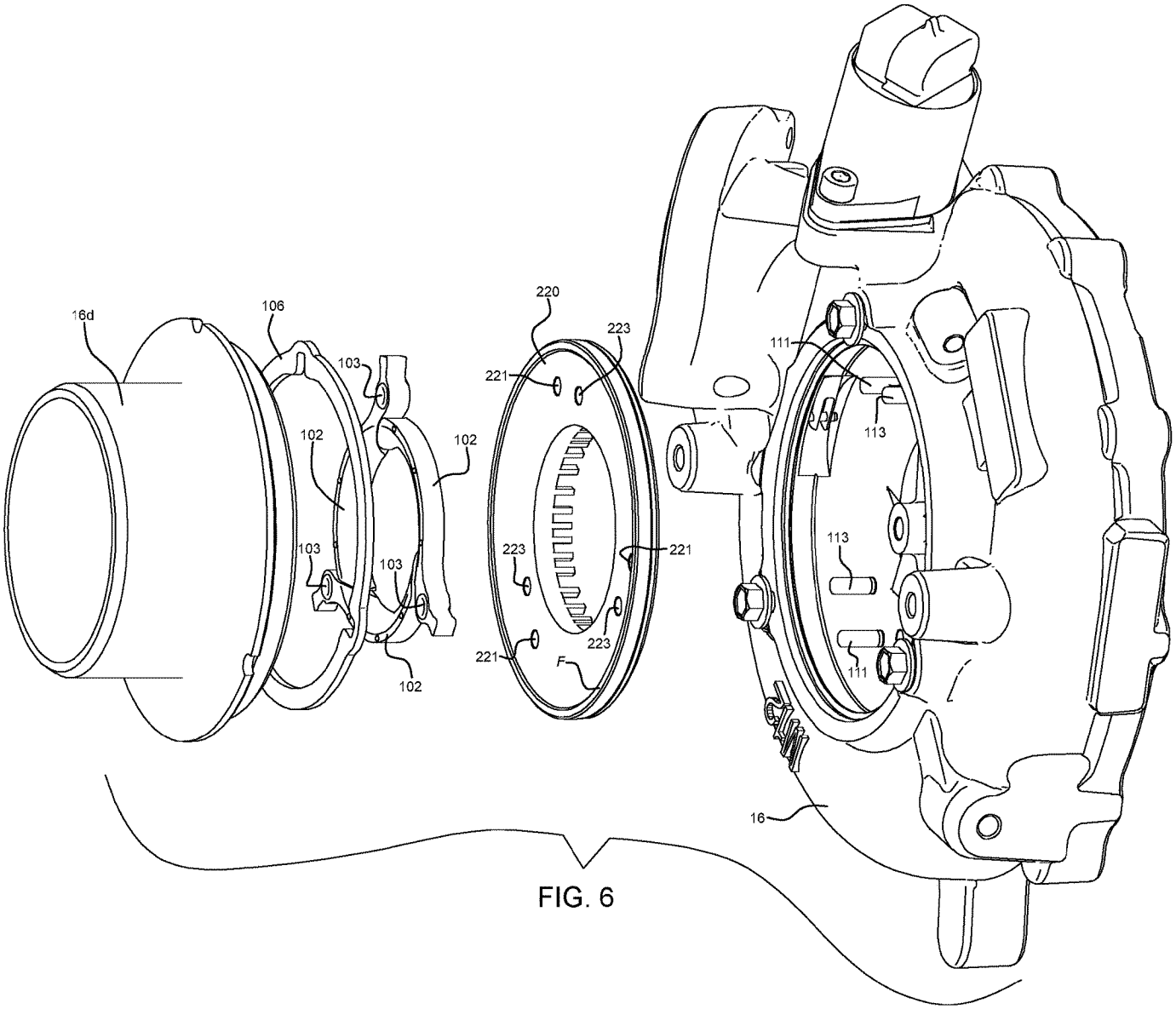
FIG. 6 is an exploded view of the compressor assembly of FIG. 5.
Figure 7:
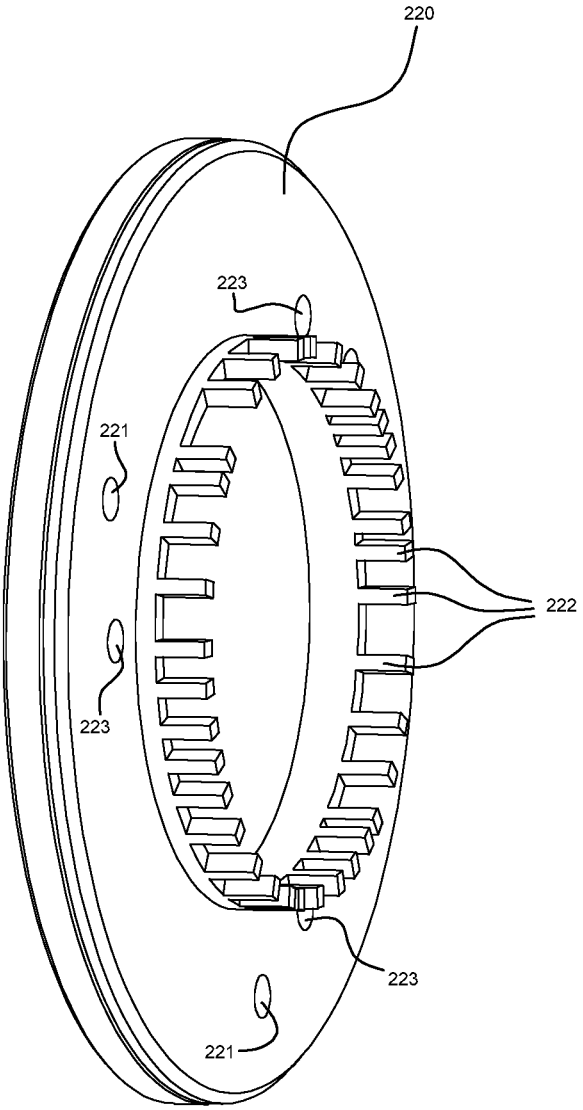
FIG. 7 is an isometric view of the noise-attenuator for the compressor assembly of FIG. 5.

A turbocharger in accordance with a second embodiment of the invention is now described with reference to FIGS. 5 through 7. The turbocharger of the second embodiment differs from that of the first embodiment with respect to the noise-attenuator, but in other respects is similar, and description of the same or similar features in common between the two embodiments will not be repeated. The noise-attenuator 220 of the second embodiment comprises a ring-shaped plate having a flange F that extends in the upstream direction from a radially outer periphery of the plate and abuts the unison ring 106, similar to the first plate of the first embodiment. The blades 102 of the inlet-adjustment mechanism are pivotally mounted to the noise-attenuator 220 by pins 113 that pass through holes 223 in the plate and are fixedly mounted in holes in the downstream wall 30 of the annular space in the air inlet wall, also similar to the first embodiment. Guide pins 111 for the unison ring 106 extend through holes 221 in the plate and are mounted in holes in the wall 30 (see particularly, FIG. 5).

However, unlike the first embodiment, the noise-attenuator of the second embodiment includes a plurality of fingers 222 that extend in the downstream direction from a radially inner periphery of the noise-attenuator. The noise-attenuator 220 cooperates with the annular space S to define an annular cavity C. The fingers 222 bridge across the cavity C and are non-uniformly circumferentially spaced about an entire circumference of the air inlet. Each of the fingers 222 causes a sudden change in impedance to the air approaching the compressor wheel, and because the fingers are non-uniformly spaced, the impedance continuously varies about the circumference, which helps prevent transmission of noise.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A turbocharger, comprising:

a turbine including a turbine housing;

a compressor assembly comprising a compressor housing and a compressor wheel mounted in the compressor housing and connected to a rotatable shaft for rotation therewith, the compressor wheel having blades and defining an inducer portion, the compressor housing having an air inlet wall defining an air inlet for leading air generally axially into the compressor wheel, the air inlet wall defining an annular space therein upstream of the compressor wheel, a radially innermost extremity of the annular space being open to the air inlet;

an inlet-adjustment mechanism disposed in the air inlet and adjustable between an open position and a closed position, the inlet-adjustment mechanism comprising a plurality of blades disposed about the air inlet and collectively circumscribing an orifice, the blades being movable radially inwardly into the air inlet when the blades are in the closed position so as to cause the orifice to have a reduced diameter relative to a nominal diameter of the inlet; and a noise-attenuator disposed in the annular space downstream of the inlet-adjustment mechanism, the noise-attenuator being structured and arranged to define axially consecutive first and second annular cavities each of which is open to the air inlet, the first annular cavity having a radial height h1 and the second annular cavity having a radial height h2.

2. The turbocharger of claim 1, wherein h1 and h2 are not equal.

3. The turbocharger of claim 1, wherein each of the first and second annular cavities has an axial width that is greater than an axial thickness of the second plate.

4. The turbocharger of claim 1, wherein h1 and h2 are equal.

5. The turbocharger of claim 1, wherein the noise-attenuator comprises a ring-shaped first plate and a ring-shaped second plate axially abutting the first plate.

6. The turbocharger of claim 5, wherein the first plate defines a flange at a radially outer periphery thereof, the flange projecting axially upstream from an upstream face of the first plate.

7. The turbocharger of claim 6, wherein the inlet-adjustment mechanism includes a rotatable unison ring for actuating movement of the blades, the unison ring abutting the flange, the flange forming a bearing surface for the unison ring when the unison ring is rotated.

8. The turbocharger of claim 7, wherein the blades are pivotally mounted to the first plate, the blades engaging the unison ring such that rotation of the unison ring in one direction or an opposite direction causes the blades to pivot radially inwardly or radially outwardly for adjusting a size of the orifice.

9. A turbocharger, comprising:

a turbine including a turbine housing;

a compressor assembly comprising a compressor housing and a compressor wheel mounted in the compressor housing and connected to a rotatable shaft for rotation therewith, the compressor wheel having blades and defining an inducer portion, the compressor housing having an air inlet wall defining an air inlet for leading air generally axially into the compressor wheel, the air inlet wall defining an annular space therein upstream of the compressor wheel, a radially innermost extremity of the annular space being open to the air inlet;

an inlet-adjustment mechanism disposed in the air inlet and adjustable between an open position and a closed position, the inlet-adjustment mechanism comprising a plurality of blades disposed about the air inlet and collectively circumscribing an orifice, the blades being movable radially inwardly into the air inlet when the blades are in the closed position so as to cause the orifice to have a reduced diameter relative to a nominal diameter of the inlet; and a noise-attenuator disposed in the annular space of the air inlet wall, downstream of the inlet-adjustment mechanism, the noise-attenuator cooperating with the annular space to define an annular cavity, and the noise-attenuator comprising a plurality of elongate fingers that bridge across from an upstream side to a downstream side of the annular cavity, adjacent a radially inner end thereof, the fingers being non-uniformly circumferentially spaced about an entire circumference of the air inlet.

10. The turbocharger of claim 9, wherein the noise-attenuator comprises a ring-shaped plate, the fingers projecting axially downstream from a downstream face of the plate adjacent a radially inner periphery thereof.

11. The turbocharger of claim 10, wherein the plate defines a flange at a radially outer periphery thereof, the flange projecting axially upstream from an upstream face of the plate.

12. The turbocharger of claim 11, wherein the inlet-adjustment mechanism includes a rotatable unison ring for actuating movement of the blades, the unison ring abutting the flange, the flange forming a bearing surface for the unison ring when the unison ring is rotated.

13. The turbocharger of claim 12, wherein the blades are pivotally mounted to the plate, the blades engaging the unison ring such that rotation of the unison ring in one direction or an opposite direction causes the blades to pivot radially inwardly or radially outwardly for adjusting a size of the orifice.

* * * * *